US005467112A

United States Patent [19]

Mitani

[11] Patent Number: 5,467,112

[45] Date of Patent: Nov. 14, 1995

[54] LIQUID DROPLET EJECTING APPARATUS

[75] Inventor: Masao Mitani, Katsuta, Japan

[73] Assignee: Hitachi Koki Co., Ltd., Tokyo, Japan

[21] Appl. No.: 78,655

[22] Filed: Jun. 21, 1993

[30] Foreign Application Priority Data

Jun. 19, 1992 [JP] Japan ..... 4-160781

[51] Int. Cl.[6] ..... B41V 2/05

[52] U.S. Cl. ..... 347/1; 347/54; 347/88; 222/14; 222/420

[58] Field of Search ..... 347/54, 58, 61, 347/62, 63, 2, 1, 88; 222/420, 14

[56] References Cited

U.S. PATENT DOCUMENTS

| | | | |
|---|---|---|---|
| 3,747,120 | 7/1973 | Stemme | 347/70 |
| 4,380,018 | 4/1983 | Andoh | 347/68 |
| 4,480,259 | 10/1984 | Kruger | 347/63 |
| 4,490,731 | 12/1984 | Vaught | 347/88 |
| 4,684,956 | 8/1987 | Ball | 347/88 |
| 4,714,936 | 12/1987 | Helinski | 347/88 X |
| 4,881,318 | 11/1989 | Komuro | 347/58 X |
| 4,934,564 | 6/1990 | Piatt | 347/1 X |
| 5,064,711 | 11/1991 | Ito | 347/1 X |
| 5,206,659 | 4/1993 | Sakurai | 347/62 |

*Primary Examiner*—Joseph W. Hartary

*Attorney, Agent, or Firm*—Whitham, Curtis, Whitham & McGinn

[57] ABSTRACT

An ink jet printhead for ejecting an ink from a nozzle. An ink ejection chamber holding ink confronts the nozzle. The liquid ejection chamber shares with a sealed pressure chamber one wall made from a thin film. The sealed pressure chamber is filled with a liquid that generates a bubble when heated to its boiling point. To another wall of the sealed pressure chamber is formed a heat resistor for rapidly heating the pressurizing liquid to its boiling point which is higher than the operation temperature.

20 Claims, 1 Drawing Sheet

LIQUID DROPLET EJECTING APPARATUS

BACKGROUND OF THE INVENTION

1. Field of the invention

The present invention relates to a liquid droplet ejecting apparatus, and more particularly to the liquid droplet ejecting apparatus applicable as a recording apparatus, a dispenser, or a picture drawing apparatus.

2. Description of the Related Art

Liquid droplet ejecting apparatuses are used for many applications, the most well known being in print heads for ink jet printers. The following explanations relate to ink jet printers.

Japanese Patent Application Kokai No. SHO-48-9622 describes two general apparatuses for ink jet printing wherein ink within an ink channel has applied thereto a pulse of pressure which ejects the ink from a nozzle. In one apparatus, hereinafter referred to as a piezoelectric type ejector, the pulses of pressure are applied by deformation of a piezoelectric element. In the other apparatus, hereinafter referred to as a bubble ink jet apparatus, a heat resistor rapidly heats a portion of the ink in the ink channel to generate a bubble. The expanding bubble ejects ink from the nozzle whereupon the bubble rapidly collapses, allowing generation of a subsequent bubble.

Japanese Patent Application Kokai No. SHO-59-26270 and Japanese Patent Application Kokai No. SHO-61-69467 describe another ink jet printer which ejects droplets by pressure generated from an expanding bubble. Japanese Patent Application Kokai No. SHO-61-69467 describes a sealed pressure chamber type ejector with a sealed chamber filled with a pressurizing liquid (a liquid which generates a bubble when heated to its boiling point by a thermal pulse, the expansion of the bubble increasing the pressure in the sealed chamber). One surface of the sealed chamber is formed from a resilient pressure transfer plate. A bubble is generated in the pressurizing liquid in response to a pulse of heat. The pressure transfer plate deforms under the increase in pressure in the sealed chamber. The deformation of the pressure transfer plate pressurizes the ink in the ink channel and ejects it from a nozzle. Further, the pressurizing liquid filling the pressure chamber is a liquid with low boiling point such as an alcohol-based, water-based, or organic-solvent-based liquid.

Unlike bubble ink jet apparatuses which heat the ink, sealed pressure chamber type ejectors and piezoelectric type ejectors pressurize the ink, and can eject even heat sensitive liquids, as long as they are not too viscous. However, only piezoelectric type ejectors are conventionally produced for ejecting hot-melt ink. Hot-melt ink is solid at room temperatures, and therefore must be heated and melted before being ejected as a liquid. Japanese Patent Application Kokai No. HEI 2-111549 describes a sealed pressure chamber type ejector for ejecting hot-melt ink, and further describes that water forms a good pressurizing liquid, but an actual apparatus has yet to be produced.

No concrete structures or specific methods of operation are provided in the art for examples of sealed pressure chamber type printers, such as those described in Japanese Patent Application Nos. SHO-59-26270 which corresponds to U.S. Pat. No. 4,480,259, SHO-61-69467, and HEI-2-111549. Also, no practical examples have been announced. When determining the melting point of hot-melt ink to be used in a printer, two points must be taken into consideration. On the one hand, the higher the boiling point, the better the characters printed on recording paper will wear in storage. On the other hand, the lower the boiling point of hot-melt ink, the easier the hot-melt ink is to melt. Hot-melt ink with melting point of 60° C. is commonly used as a compromise between these two requirements. All piezoelectric ink jet printers produced today maintain at least the entire ink channel between 130° and 150° C. to lower the viscosity of the liquid hot-melt ink to the range of 10 to 20 mpa or lower as required for proper ejection.

A sealed pressure chamber type ejector must also meet the same conditions to eject hot-melt ink. That is, the temperature at the ink side of the pressure transfer plate must be 130° to 150° C. Further, the pressure transfer plate must have good resilience. It must be a metal thin film or thin film of a heat-resistant resin from several μms to several 10's of μms thick. Also, the temperature of the pressure chamber sealed on one side by the pressure transfer plate must be maintained at a temperature near that of the liquid hot-melt ink.

Japanese Patent Application No. HEI-2-111549 recommends that water form the pressurizing liquid in the sealed pressure chamber type hot-melt ink jet printer described therein. However, unless some type of heat isolation is provided at the pressure transfer plate, maintaining the hot-melt ink at 130° to 150° C. would raise the temperature of the water in the pressure chamber to near the same temperature, raising the pressure of the water to three to five atmospheres. Consequently, the pressure transfer plate would normally be expanded into the ink channel. While the pressure transfer plate is in this expanded condition, bubble pressure cannot increase the pressure in the sealed pressure chamber sufficiently for ejecting the ink.

SUMMARY OF THE INVENTION

The present invention has been made to solve the above-noted problems, and accordingly it is an object of the invention to provide a liquid droplet ejecting apparatus capable of ejecting a predetermined amount of liquid such as ink, chemical or the like.

To achieve the above and other objects, there is provided a liquid droplet ejecting apparatus for ejecting a liquid from a nozzle. The apparatus includes a liquid ejection chamber for holding liquid to be ejected from the nozzle. There is provided a pressure chamber which has an internal volume filled with a pressurizing liquid. The pressurizing liquid has a boiling point higher than the temperature in the liquid ejection chamber. Heating the pressurizing liquid to its boiling point generates a bubble therein. Expansion of the bubble increases pressure in the pressure chamber. Heat applying means is provided for selectively heating the pressurizing liquid to the boiling point. Pressure applying means applies pressure to the liquid ejection chamber by deforming with increased pressure in the pressure chamber to eject a liquid droplet.

In the liquid droplet ejecting apparatus thus constructed, even if the temperature in the pressure chamber is maintained at an operating temperature, the pressure in the pressure chamber is below one atmosphere. If the pressure in the liquid ejection chamber is about one atmosphere, the pressure applying means, which is preferably a metal thin film, is deformed into the pressure chamber. Only when the pressurizing liquid filling the pressure chamber is heated by the heat applying means, does the pressure in the pressure chamber increase above one atmosphere. As a result, due to the deformation of the metal thin film, the liquid contained in the liquid ejection chamber is ejected through the nozzle.

In the present invention, a single layer heat resistor can be used as the heat applying means, which layer can have a heating efficiency three to five times as large as that of the conventionally used heat resistor covered with a protective layer.

BRIEF DESCRIPTION OF THE DRAWINGS

The above and other objects, features and advantages of the invention will become more apparent from reading the following description of the preferred embodiments taken in connection with the accompanying drawings in which.

DETAILED DESCRIPTION OF THE PREFERRED EMBODIMENTS

Figure 1:
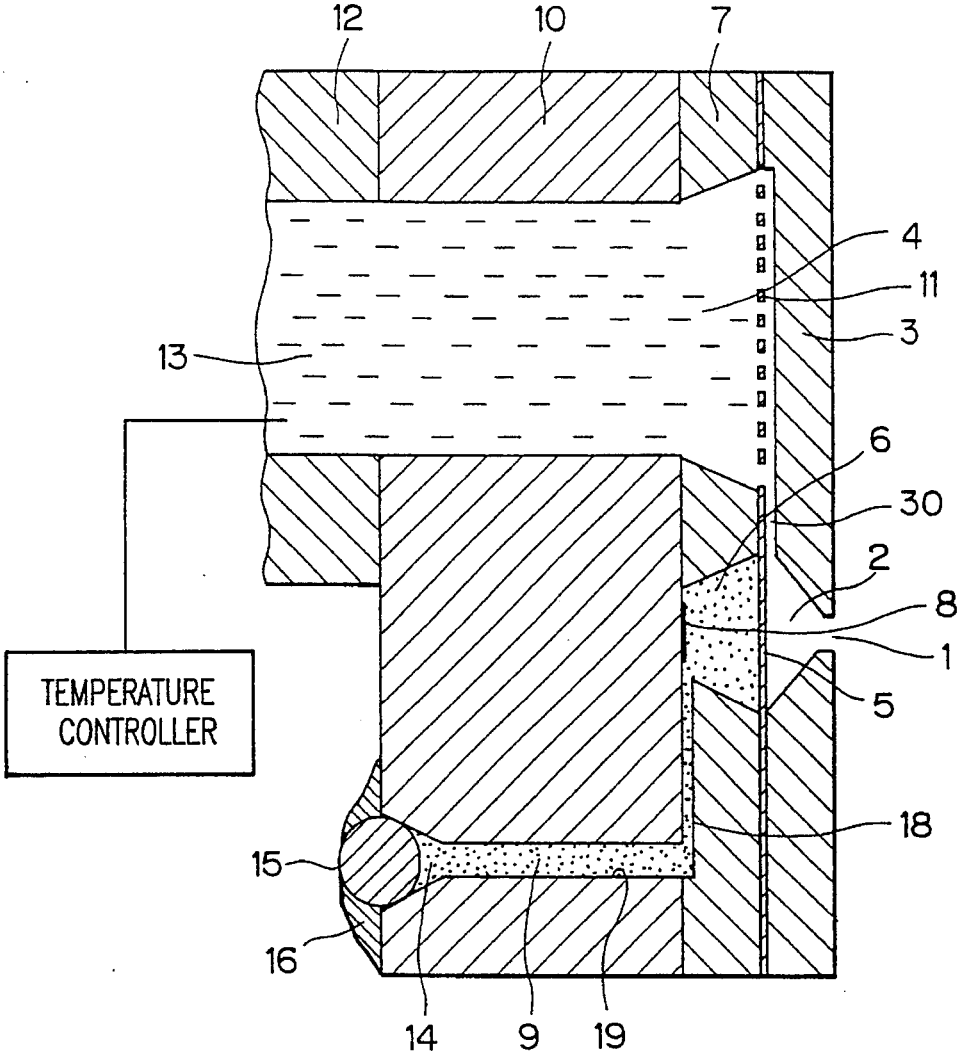
FIG. 1 is a cross-sectional view showing a liquid droplet ejecting apparatus according to the present invention.

Preferred embodiments of the present invention will be described while referring to the accompanying drawings. A first embodiment describes the liquid droplet ejecting apparatus shown in FIG. 1 for ejecting melted hot-melt ink through a nozzle 1. The nozzle 1 is formed in a side of a glass substrate 3. To the opposing side of the glass substrate 3 is formed an ejection chamber 2 for temporarily holding the ink to be ejected. The ejection chamber 2 is in liquid communication with the nozzle 1.

A pressure chamber 6 adjacent to the ejection chamber 2 is formed in a glass substrate 7 to have a substantially truncated-cone shape. A metal thin film 5 anode bonded between the glass substrate 3 and the glass substrate 7 separates the liquid ejection chamber 2 from the pressure chamber 6. The metal thin film 5 forms the base of the substantially truncated-cone shape of the pressure chamber 6.

A glass substrate 10 bonded to the glass substrate 7 forms the top of the truncated-cone shape of the pressure chamber 6. To this surface of the glass substrate 10 is formed a heat resistor 8. A connecting groove 18 and an insert channel 19 are formed in the glass substrates 7 and 10, respectively, and are fluidly connected to the pressure chamber 6. The pressure chamber 6, the connecting groove 18, and the insert channel 19 form a sealed space filled with a pressurizing liquid 9. A sealing port 14 at the end of the insert channel 19 opposing the connecting channel 18 is sealed by a cover 15.

A through-hole 30 connecting the ejection chamber 2 to a broad opening 4 of an ink channel 13 is formed in the glass substrate 3. In the broad opening 4, the metal thin film 5 forms a filter 11 containing a plurality of holes. The ink channel 13 is connected to a hot-melt ink melting tank (not shown) via an ink supply pipe 12 bonded to the glass substrate 10. The hot-melt ink melting tank supplies ink to the ejection chamber 2 via the ink supply pipe 12, the ink channel 13, and the through-hole 30.

The ink supply pipe 12 and the hot-melt ink melting tank are heated to about 130° C. to melt the hot-melt ink into a liquid and the sufficiently reduce its viscocity. The liquid droplet ejecting apparatus is maintained at 128° C. by a positive temperature coefficient (PTC) heater (not shown).

The methods used to manufacture and assemble the components of the liquid droplet ejecting apparatus will next be explained.

The glass substrate 10 with linear thermal expansion coefficient of $8\times10^{-6}$/° C. was formed to 0.7 mm thick. To form the heat resistor 8, an approximately 1,000 Å thick Cr— Si—SiO alloy thin-film resistor layer was formed on the glass substrate 10 with sputtering according to the method described in Japanese Patent Application Kokai SHO-58-84401. Next, an approximately 2 μm Ni thin-film conductor layer was formed on the thin-film resistor layer. The Ni thin-film conductor layer was then photoetched using a pattern mask. Afterward, using another pattern mask, the heating surface of the heat resistor 8 was photoetched into a square shape with sides each about 50 μm and with resistance about 1KΩ.

The ink channel 13 and the insert channel 19 were etched in glass substrate 10. The ink channel 13 was actually etched to taper into the broad opening 4. However, this shape is not shown in FIG. 1 because it does not adversely effect operational efficiency or ease of assembly.

The glass substrate 7 made of the same material as glass substrate 10 was formed to 0.3 mm thick. Shapes were formed in the glass substrate 7 for the broad opening 4, the pressure chamber 6, and the connecting groove 18 so that when the substrate 7 abuts the glass substrate 10 the shape for the broad opening 4 aligns with the ink channel 13, and the end of the shape for the connecting groove 18 opposing the shape for the pressure chamber 6 aligns with the insert channel 19. The shape to form the pressure chamber 6 is approximately 150 μm in diameter at the side to abut the glass substrate 10 and about 250 μm diameter at the side to confront the liquid ejection chamber 2. A plurality of pressure chambers (48 in the first embodiment) were formed at a pitch of 350 μm in the direction perpendicular to the cross-sectioned surface shown in FIG. 1.

The metal thin-film layer 5 was formed on the glass substrate 7 from a 10 μm thick rolled Ta thin film. A plurality of holes each approximately 25 μm in diameter was formed in the metal thin-film layer at the broad opening 4 to form the filter 11.

The glass substrate 3 made from the same material as the glass substrates 7 and 10 was formed to 0.2 mm thick. In the glass substrate 3 were photoetched 48 ejection chambers 2 at positions confronting the 48 pressure chambers 6. The through-hole 30 was also photoetched in the glass substrate 3. The ejecting nozzle 1 was previously photoetched from the external side (side facing away from the ejection chamber) to reduce dimensional tolerance not greater than +/–4 μm with respect to 40 μm diameter hole.

Next, all glass substrates were assembled as described below. A sealing glass with linear thermal expansion coefficient 5 to 10% less than the linear thermal expansion coefficient of the glass substrates 3, 7, and 10 is printed to the glass substrate 10. After the binder was burned off, the glass substrate 10 was aligned with the glass substrate 7 and secured under pressure at about 500° C.

Next, the Ta thin-film 5 and the glass substrate 3 were stacked on and aligned with the bonded glass substrates 10 and 7. The resultant assembly was sandwiched between stainless electrode plates, fixed by an electric isolator, and heated to 450° C. in an electric oven. While in the oven, a 1,000 to 1,500 V voltage was applied between one of the stainless steel electrodes and the Ta thin film 5, with the Ta thin film 5 as the positive electrode. Ten minutes later another 1,000 to 1,500 V voltage was applied for ten minutes between the other of the stainless steel electrodes and the Ta thin film 5. This method is termed anodic bonding and is described in U.S. Pat. No. 3,397,278. This method forms an airtight seal between the three glass substrates and the Ta thin film using only these materials described above.

It should be noted that a plurality of liquid droplet ejecting apparatuses were assembled at the same time during the above operation, only one of which is shown in cross section in FIG. 1. The 48 conductors connected to the 48 heat resistors 8, and the one common conductor are provided to the glass substrates 3, 7, and 10. Individual external connection terminals (not shown) for each resistor and one common external connector terminal (not shown) are formed to the glass substrate 10 before assemblage. So these are not covered by the glass substrates 3 and 7, and the thin film 5, after assemblage, the portions of the glass substrates 3 and 7, and the thin film 5, that would otherwise cover the terminals were removed during photoetching processes before assemblage.

The ink supply pipe 12 was glass-bonded to the ink channel 13 of the liquid droplet ejecting apparatus. The liquid droplet ejecting apparatus was placed in a vacuum chamber and the vacuum chamber evacuated. The sealing port 14 was filled with a heat resistant pressurizing liquid 9, that is, perfluorodecalin, $C_{10}F_{18}$. Afterward, nitrogen gas was introduced in the vacuum chamber bit by bit to return the pressure therein to 0.1 to 0.2 atmospheric pressure. Excess perfluorodecalin was wiped off the area surrounding the sealing port 14. The cover 15 was inserted into the sealing port 14 and sealed thereto with molten Sn or Sn—Au solder while ultrasonic waves were applied from above. Heating the liquid droplet ejecting apparatus to 100° C. or anode bonding a circular copper or nickel film around the sealing port 14 would provide a good seal between the solder and the sealing port 14. After sealing, the pressure in the pressure chamber remained constant and therefore lower than the ambient pressure after the liquid droplet ejecting apparatus was removed from the vacuum chamber. The low pressure in the pressure chamber was maintained even when the liquid droplet ejecting apparatus was heated to 135° C. The boiling point of the sealed perfluorodecalin is 142° C., sufficient heat resistance for use as the pressurizing liquid.

The following text will further explain the glass substrates and the Ta thin film composing the liquid droplet ejecting apparatus. The glass material must have a linear thermal expansion coefficient 10 to 20% larger than that of the metal thin film 5. Similarly, the Ta thin film must have a linear thermal expansion coefficient smaller than that of the glass within the temperature range from 100° to 400° C. to ensure that the Ta thin film has sufficient corrosion and heat resistance, springiness, non-reactivity to the ejection liquid and the pressurizing liquid 9, receptiveness to anodic bonding with the glass, and the like. Only assembling the liquid droplet ejecting apparatus as shown in FIG. 1 can provide sag to the metal thin film sufficient for transmitting pressure generated within the pressure chamber 8 into movement sufficient for ejecting ink from the ejection chamber 2. The Ta thin film can be replaced by thin films of molybdenum, niobium, tungsten, zirconium, or Invar (trademark) for producing the liquid droplet ejecting apparatus.

Next, the pressurizing liquid 9 sealed in the pressure chamber will be explained. The operating temperature of the liquid droplet ejecting apparatus according to the first preferred embodiment is 128° C.+/−3° C. Therefore, any non-toxic liquid with a boiling point and a decomposition temperature higher than that of the operating temperature can be used as the pressurizing liquid 9. For example, several silicon oils produced by Shinetsu Silicon Inc. with dimethyl polysiloxane structures, such as its KF96L-1 (boiling point 153° C.), KF96L-1.5 (boiling point 195° C.), or KF96L-2 (boiling point 230° C.) can replace perfluorodecalin. The above mentioned KF96L-2 is suitable when the liquid droplet ejecting apparatus is operated at a temperature higher than 128° C.+/−3° C., for example, 200° C.

The heat resistor should possess heating power sufficient to heat the pressurizing liquid 9 to its boiling point. A pressurizing liquid 9 with an excessively high boiling point would require heating to temperatures that could damage the liquid droplet ejecting apparatus if transfer of heat therein is excessively efficient. Including a temperature controller for suppressing the temperature increase caused by such an excessive application of energy would adversely increase the complexity of the liquid droplet ejecting apparatus. Consequently, the pressurizing liquid 9 should have a boiling point as low as possible to maintain a reduced pressure in the pressure chamber between pulse heatings. About 10° to 50° C. higher than the operation temperature would be the most suitable range.

The present inventor maintained the liquid droplet ejecting apparatus indicated in FIG. 1 as produced according to the method described above at a temperature of 128° C.+/−3° C. Hot-melt ink was melted at about 130° C. and supplied to the ejection chambers 2. A 5 V, 10 μs duration pulse voltage was applied to the heat resistors 8 at a frequency of 5 KHz. On demand printing was successfully performed by the liquid droplet ejecting apparatus to clearly print characters onto an incrementally fed recording paper positioned about 1.2 mm away from the ejecting nozzle. The frequency was increased to increase speed of printing, but quality of characters degraded at frequencies of 7 to 8 KHz and higher resulting from limitations at the ink channel side including the material of the hot-melt ink. Since the maximum frequency attainable by the pressure chamber is higher, the maximum frequency of the liquid droplet ejecting apparatus can be increased by improving the ink channel and related components.

Next, a liquid droplet ejecting apparatus according to a second preferred embodiment of the present invention will be explained. The structure, assembly, and performance of the liquid droplet ejecting apparatus according to the second preferred embodiment are the same as those of the first preferred embodiment. The liquid droplet ejecting apparatus according to the second preferred embodiment differs from the liquid droplet ejecting apparatus according to the first preferred embodiment in that the thin-film resistor is made from Ta—Si—SiO, the conductor is made from nickel, chromium, molybdenum, tungsten, or tantalum, and the pressurizing liquid 9 is ethyl alcohol. The present inventor produced a liquid droplet ejecting apparatus according to the second preferred embodiment, supplied ink that is liquid at room temperature to the ejection chambers 2, and successfully ejected ink from the liquid droplet ejecting apparatus at room temperature and at printing speeds with frequency of 5 to 7 KHz. Because the liquid droplet ejecting apparatus need not be heated, basically any type of ink can be used therein.

Next, a liquid droplet ejecting apparatus according to a third preferred embodiment will be explained. The liquid droplet ejecting apparatus according to the third preferred embodiment has the same structure as that of the second preferred embodiment but is used as a micropipet (microdispensor) for ejecting predetermined amounts of liquid reagent. This liquid droplet ejecting apparatus is suitable for supplying liquid reagents sensitive to heat, because it does not heat liquids when ejecting as does a conventional bubble jet printer.

For example, in blood analysis, a liquid droplet ejecting apparatus according to the third preferred embodiment is equipped with a nozzle for supplying an approximately 45 $\mu m^3$ droplet. A test tube or similar vessel holding a blood sample is placed where ejected reagent droplets will fall. A host computer commands the heat resistor 8 to pulse heat the number of times required to eject a predetermined amount of reagent. For example, the host computer would command the heat resistor 8 to heat two times to supply 90 $\mu m^3$ of reagent. Supplying a different chemical to each of a plurality of ejection chambers 2 produces a micropipet capable of selectively ejecting desired chemicals in desired amounts. Larger volumes of reagent can be supplied, but at a slower operating frequency, by enlarging the pressure chamber 6 and the ejection chamber 2.

Next, a liquid droplet ejecting apparatus according to a fourth preferred embodiment will be explained. The liquid droplet ejecting apparatus according to the fourth preferred embodiment supplies an emulsion to directly draw a mask for photoetching. A paste for thick film printing can also be supplied to directly depict a circuit pattern to form a thick film circuit on a ceramic substrate.

For example, although the effort required to make a mask is justifiable when producing large quantities of the same circuit, this is not the case when making test circuits. A liquid droplet ejecting apparatus according to the fourth preferred embodiment with a plurality of droplet ejecting nozzles is supplied with a silver paste. The liquid droplet ejecting apparatus ejects the silver paste onto the surface of the ceramic at the command of a host computer so that circuit boards can be formed as desired. However, conventional printing pastes must be thinned with a low viscosity solvent before being used in the depicted liquid droplet ejecting apparatus.

The depicted liquid droplet ejecting apparatus can also form resistors. Materials with different resistances are supplied to each of the plurality of nozzles to apply the necessary resistance material in proper volumes to a substrate made from, for example, ceramic.

Figure 2:
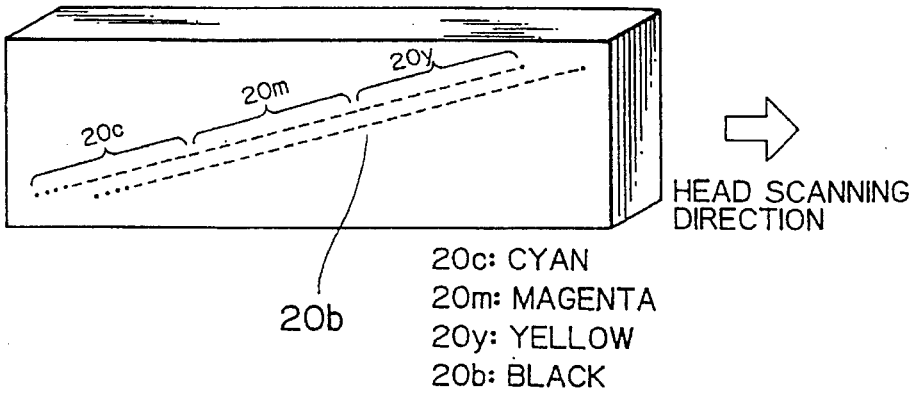
FIG. 2 is a perspective view showing a four-color printhead according to a fifth preferred embodiment of the present invention.

The following text describes a liquid droplet ejecting apparatus according to a fifth preferred embodiment of the present invention. The liquid droplet ejecting apparatus according to the fifth embodiment is constructed substantially the same as that of the first embodiment but with a plurality of liquid supply pipes connected to the desired number and arrangement of pressure chambers 6 and ejection chambers 2. For example, FIG. 2 shows a print head for a four color ink jet printer wherein the plurality of ink droplet ejection nozzles are arranged in two rows slanting at an angle in relation to the scanning direction of the print head. Three types of colored ink, cyan 20*c*, magenta 20*m*, and yellow 20*y* fill the upper row of ejection chambers 2 and black ink 20*b* fills the lower row of ejection chambers 2. When the head is constructed for using hot-melt type ink, the nozzle surface of the head does not need cleaning during printing as does the nozzle surface of a bubble jet printer. Colors will not mix even when the head is integrally formed.

Although the present invention has been described with respect to various embodiments, it can be understood for a person skilled in the art that a variety of changes and modifications may be made without departing from the scope and spirit of the invention.

What is claimed is:

1. A liquid droplet ejecting apparatus for ejecting a liquid from a nozzle, comprising:

a liquid ejection chamber for holding liquid to be ejected from the nozzle, said liquid ejection chamber having a temperature;

a liquid ejection chamber temperature controller for maintaining the temperature in said liquid ejection chamber in a range of 128° C.+ /−3° C.;

a pressure chamber having an internal volume filled with a pressurizing liquid, the pressurizing liquid having a boiling point higher than the temperature in said liquid ejection chamber, the pressurizing liquid generating a bubble when heated to the boiling point, expansion of the generated bubble increasing pressure within the pressure chamber;

heat applying means for selectively heating the pressurizing liquid to the boiling point; and pressure applying means for applying pressure to said liquid ejection chamber by deforming with increasing pressure in the pressure chamber to eject a liquid droplet.

2. The liquid droplet ejecting apparatus as claimed in claim 1, wherein said heat applying means comprises a heat resistor formed from a Cr—Si—SiO thin-film resistor and a conductor.

3. The liquid droplet ejecting apparatus as claimed in claim 2, wherein said conductor is a nickel thin-film conductor.

4. The liquid droplet ejecting apparatus as claimed in claim 2, wherein said conductor is a chrome thin-film conductor.

5. The liquid droplet ejecting apparatus as claimed in claim 2, wherein said conductor is a molybdenum thin-film conductor.

6. The liquid droplet ejecting apparatus as claimed in claim 2, wherein said conductor is a tungsten thin-film conductor.

7. The liquid droplet ejecting apparatus as claimed in claim 2, wherein said conductor is a tantalum thin-film conductor.

8. The liquid droplet ejecting apparatus as claimed in claim 1, wherein said liquid ejection chamber is formed in a glass substrate made from a glass material having a linear thermal expansion coefficient, and wherein said pressure chamber is formed in another glass substrate made from the glass material same as said glass substrate, said glass substrate and said another glass substrate being secured to each other by a cover glass material having another linear thermal expansion coefficient lower than the linear thermal expansion coefficient of the glass material.

9. The liquid droplet ejecting apparatus as claimed in claim 8, wherein said pressure applying means comprises a metal thin film positioned between said pressure chamber and said liquid ejection chamber, said metal thin film being bound to said glass substrate and said another glass substrate, said metal thin film having a linear thermal expansion coefficient smaller than that of said glass substrate and said another glass substrate.

10. The liquid droplet ejecting apparatus as claimed in claim 9, wherein said thin film comprises a tantalum thin-film.

11. The liquid droplet ejecting apparatus as claimed in claim 1, wherein the nozzle from which the liquid droplet is ejected is maintained at an operating temperature in a range of 128°±3° C. and the boiling point of the pressurizing liquid is higher than the operating temperature by 10° to 50° C.

12. The liquid droplet ejecting apparatus as claimed in claim 1, further comprising:

a liquid channel for supplying said liquid to said liquid ejection chamber, said liquid channel having a first end and a second end, wherein said first end receives said liquid from an external source and said second end supplies said liquid to said liquid ejection chamber, wherein said second end includes a filter for filtering said liquid.

13. The liquid droplet ejecting apparatus as claimed in claim 12, wherein said pressure applying means comprises a thin-metal film, and wherein said thin-metal film includes a plurality of perforations, said filter comprising said plurality of perforations.

14. The liquid droplet ejecting apparatus as claimed in claim 1, wherein said pressurizing liquid is perfluorodecalin.

15. A liquid droplet ejecting apparatus for ejecting a plurality of liquid types from a plurality of nozzles, comprising:

a plurality of liquid ejection chambers each for holding one liquid type to be ejected from one nozzle, each liquid ejection chamber having a temperature;

a liquid ejection chamber temperature controller for maintaining the temperature in each of said liquid ejection chambers in a range of 128° C.+/–3° C.;

a plurality of pressure chambers in numbers equal to numbers of the plurality of liquid ejection chambers, each pressure chamber having an internal volume filled with a pressurizing liquid, the pressurizing liquid having a boiling point higher than the temperature in each liquid ejection chamber, the pressurizing liquid generating a bubble when heated to the boiling point, expansion of the generated bubble increasing the pressure in the respective pressure chamber;

a plurality of heat applying means in numbers equal to the number of the plurality of liquid ejection chambers, each heat applying means for selectively heating the pressurizing liquid to the boiling point; and a plurality of pressure applying means, in numbers equal to the number of the plurality of liquid ejection chambers, each for applying pressure to the liquid ejection chamber by deforming with increasing pressure in the respective pressure chamber to eject a liquid droplet.

16. The liquid droplet ejecting apparatus as claimed in claim 15, wherein the plurality of liquid ejection chambers are divided into groups, each group being supplied with a different liquid type.

17. The liquid droplet ejecting apparatus as claimed in claim 16, wherein said plurality of nozzles are co-planar.

18. The liquid droplet ejecting apparatus as claimed in claim 14, wherein said plurality of liquid ejection chambers are divided into linear groups.

19. A dispenser with a chemical droplet ejecting apparatus for supplying a predetermined amount of chemical, comprising:

a chemical ejection chamber for holding chemical to be ejected from a nozzle, the chemical ejection chamber having a temperature;

a chemical ejection chamber temperature controller for maintaining the temperature in said chemical ejection chamber in a range of 128° C.+/–3° C.;

a pressure chamber having an internal volume filled with a pressurizing liquid, the pressurizing liquid having a boiling point higher than the temperature in said chemical ejection chamber, the pressurizing liquid generating a bubble when heated to the boiling point, expansion of the generated bubble increasing the pressure in the pressure chamber;

heat applying means for selectively heating the pressurizing liquid to the boiling point; and pressure applying means for applying pressure to said chemical ejection chamber by deforming with increasing pressure within the pressure chamber to eject a chemical droplet.

20. A depicting apparatus for depicting patterns on a substrate with a print paste, comprising:

a print paste ejection chamber for holding print paste to be ejected from a nozzle, said print paste ejection chamber having a temperature;

a print paste ejection chamber temperature controller for maintaining the temperature in said print paste ejection chamber in a range of 128° C.+/–3° C.;

a pressure chamber having an internal volume filled with a pressurizing liquid, the pressurizing liquid having a boiling point higher than the temperature in said print paste ejection chamber, the pressurizing liquid generating a bubble when heated to the boiling point, expansion of the generated bubble increasing the pressure within the pressure chamber;

heat applying means for selectively heating the pressurizing liquid to the boiling point; and pressure applying means for applying pressure to said print paste ejection chamber by deforming with increasing pressure within the pressure chamber to eject a print paste droplet.

* * * * *